United States Patent [19]

Kobayashi

[11] Patent Number: 4,984,390

[45] Date of Patent: Jan. 15, 1991

[54] GRINDING DISC DRESSING APPARATUS

[75] Inventor: Shigeo Kobayashi, Kanagawa, Japan

[73] Assignee: Nippei Toyama Corporation, Tokyo, Japan

[21] Appl. No.: 433,870

[22] Filed: Nov. 9, 1989

[51] Int. Cl.[5] ..... B24B 53/00

[52] U.S. Cl. ..... 51/5 D; 125/11.17; 125/11.01; 125/11.16; 125/11.19

[58] Field of Search ..... 125/11 AS, 11 BS, 11 DF, 125/11 ST, 11 R; 51/5 D, 165.71, 165 R, 165.22

[56] References Cited

U.S. PATENT DOCUMENTS

| | | | |
|---|---|---|---|
| 2,285,717 | 6/1942 | Indge | 125/11 ST |
| 3,822,689 | 7/1974 | Oshima | 125/11 DF |
| 4,103,668 | 8/1978 | Nishimura | 51/165.71 |
| 4,274,231 | 6/1981 | Verega | 51/165.71 |
| 4,603,511 | 8/1986 | Kamatsu | 51/165.71 |
| 4,635,401 | 1/1987 | Nakaji | 51/5 D |
| 4,805,585 | 2/1989 | Halvorsen | 125/11 BS |

*Primary Examiner*—Frederick R. Schmidt

*Assistant Examiner*—Blynn Shideler

*Attorney, Agent, or Firm*—Sughrue, Mion, Zinn, Macpeak & Seas

[57] ABSTRACT

A grinding disc dressing apparatus for dressing an active grinding side or surface of a grinding disc of a surface grinding machine includes feed means for moving a dressing roll between an outer periphery of the grinding disc and the central portion of the grinding disc generally radially of the grinding disc so as to dress the active grinding side of the grinding disc. First drive means rotates the dressing roll in such a manner that the speed of rotation of the dressing roll can be varied. Second drive means rotates the grinding disc in such a manner that the speed of rotation of the grinding disc can be varied. Control means controls the operation of at least one of the two drive means so as to arbitrarily vary the ratio between the peripheral speeds of the dressing roll and the grinding disc at an operating point where the dressing roll acts on the active grinding surface of the grinding disc during the dressing operation.

16 Claims, 10 Drawing Sheets

GRINDING DISC DRESSING APPARATUS

BACKGROUND OF THE INVENTION

1. Field of the Invention

This invention relates to a grinding disc dressing apparatus for use in a surface grinding machine in which one side (active grinding surface) of a grinding disc acts to grind a workpiece. Such a dressing apparatus is best suited for use in a double spindle-head grinding machine.

2. Prior Art

To achieve high-precision, high-efficiency grinding, there has been proposed a grinding machine employing a diamond grinding wheel or a grinding wheel containing super abrasive grains made, for example, of cubic boron nitride. Such a grinding machine has excellent grinding performance. However, such super abrasive grains are very hard, and therefore when the super abrasive grain grinding wheel is dressed by a diamond tool comprising a single point diamond, the diamond is subjected to premature wear. Thus, such a diamond tool is not suited for dressing the super abrasive grain grinding wheel. For this reason, it is a common practice in the art to dress such a grinding wheel using a cylindrical rotary dressing diamond roll having diamonds embedded in the outer peripheral surface of the roll.

In such a grinding wheel dressing apparatus with a rotary dresser for use in a grinding machine in which the grinding operation is effected by an outer periphery of a cylindrical grinding stone, a shaft which is parallel to the axis of the grinding stone and has a rotary dressing roll fixedly mounted thereon is driven for rotation together with the rotary dressing roll so as to dress the grinding wheel. In the dressing of such a grinding stone having the active grinding surface on its outer periphery, the rotary dressing roll is rotated at a constant speed, and at the same time is fed to the same direction of grinding wheel axis at a constant rate relative to the grinding stone. Since the grinding stone is rotated at a constant speed, the amount of feed of the rotary dressing roll per revolution of the grinding stone is constant. The ratio of the peripheral speed of the grinding stone to the peripheral speed of the rotary dressing roll is constant, and therefore the required conditions of the dressing can be easily satisfied.

With respect to such a grinding stone dressing apparatus, a sufficient space is available around the outer periphery of the grinding stone, so that the grinding stone dressing apparatus can be readily mounted in such a space, and the drive device for rotating the rotary dressing diamond roll as well as the feed device can be mounted without undue difficulty.

However, in a grinding wheel dressing apparatus for use in a surface grinding machine of the type in which a grinding stone or wheel (generally called a grinding disc or an abrasive disc) has an active grinding surface at one side thereof, the rotary dressing roll is required to be fed from the outer periphery of the grinding disc to the central portion thereof. For this reason, the grinding disc dressing apparatus inevitably becomes complicated in construction, and besides it is rather difficult to satisfy the required conditions of the dressing. Here, let's assume that the rotary dressing roll is caused to act on the active grinding surface of the grinding disc and is fed either from the outer periphery to inner periphery of the grinding disc or the inner periphery to outer periphery. When the grinding disc is rotated at a constant speed, the amount of feed of the rotary dressing roll per revolution of the grinding disc can be made constant by feeding the rotary dressing roll at a constant speed radially of the grinding disc. However, if the rotary dressing roll is rotated at a constant speed as is the case with the grinding machine having the cylindrical grinding stone whose outer periphery serves as the active grinding disc, the ratio of the peripheral speed of the rotary dressing roll to the peripheral speed of the grinding disc at the operating point of the rotary dressing roll acting on the grinding disc is not constant. Therefore, the dressing by the rotary dressing roll on the outer peripheral portion of the grinding disc differs from the dressing on the inner peripheral portion of the grinding disc which has a lower peripheral speed.

Further, the opposed sides (active grinding surfaces) of a pair of grinding discs used in a double spindle-head grinding machine can be properly dressed by using a rotary diamond roll. However, sufficient space is not available for satisfactorily accommodating the dressing apparatus, and it is rather difficult to mount the drive device for rotating the rotary dressing diamond roll and the feed device in such a manner that the two devices can satisfactorily perform the grinding disc dressing operation.

SUMMARY OF THE INVENTION

With the above deficiencies of the prior art in view, it is & an object of this invention to provide a grinding disc dressing apparatus in which a rotary dressing roll can dress an active grinding surface of a grinding disc of a surface grinding machine in such a manner that the ratio of the peripheral speed of the rotary dressing roll to the peripheral speed of the grinding disc can be arbitrarily varied during the dressing operation.

Another object of the invention is to provide such a dressing apparatus best suited for use in a surface grinding machine having a grinding disc one side of which serves as an active grinding surface.

According to one aspect of the present invention, there is a grinding disc dressing apparatus for dressing an active grinding surface of a grinding disc of a surface grinding machine, the apparatus comprising:

(a) a rotary dressing roll;

(b) feed means for moving the dressing roll between an outer periphery of the grinding disc and a central portion of the grinding disc generally radially of the grinding disc so as to dress the active grinding surface;

(c) first drive means for rotating the dressing roll;

(d) second drive means for rotating the grinding disc; and (e) control means for controlling the operation of at least one of the two drive means so as to arbitrarily vary the ratio between peripheral speeds of the dressing roll and the grinding disc at an operating point where the dressing roll acts on the active grinding surface during the dressing operation.

According to another aspect of the present invention, there is provided a grinding disc dressing apparatus for dressing a grinding disc of a surface grinding machine, comprising:

(a) a main shaft extending parallel to the axis of rotation of the grinding disc;

(b) means for angularly moving the main shaft about an axis thereof;

(c) an arm fixedly mounted on the main shaft at a proximal end of the arm disposed radially outwardly of an outer periphery of the grinding disc, so that the arm is angularly movable together with the main shaft, the arm having a distal end movable along an active grinding surface of the grinding disc;

(d) a rotary dressing roll mounted on the distal end of the arm, the dressing roll having an axis of rotation disposed in the direction of movement of the distal end of the arm, the dressing roll acting on the active grinding surface to dress the same; and (e) means for rotating the dressing roll.

DESCRIPTION OF THE PREFERRED EMBODIMENTS OF THE INVENTION

Preferred embodiments of the invention will now be described with reference to the drawings, and in these embodiments, by way of example, the ratio between the peripheral speeds of a rotary dressing roll and a grinding disc is kept constant during the movement of the dressing roll between the outer periphery and central portion of the grinding disc.

Figure 1:
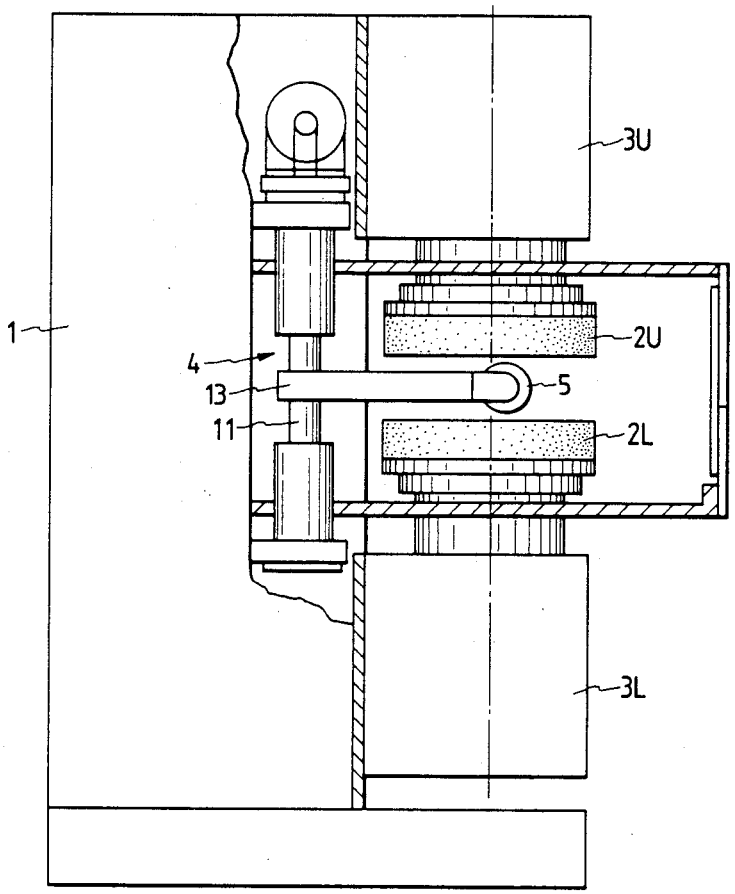
FIG. 1 is a side-elevational view of a vertical spindle double-head grinding machine.

FIG. 1 is a side-elevational view of a vertical spindle double-head grinding machine. A pair of opposed upper and lower spindle housing bases 3U and 3L are mounted on a column 1, and a pair of opposed upper and lower grinding discs 2U and 2L are mounted respectively on vertical spindles mounted respectively on the upper and lower spindle housing bases 3U and 3L. The opposed or inner sides of the upper and lower grinding discs 2U and 2L serve as active grinding surfaces by which a workpiece is ground. The vertical position of each of the upper and lower grinding discs 2U and 2L can be adjusted. For adjusting the positions of the upper and lower grinding discs 2U and 2L, the spindle housing bases 3U and 3L are engaged with guide means provided at the front side of the column 1, and are vertically moved by drive devices along the guide means. Alternatively, each spindle is received in a quill, and the quill is moved outwardly and inwardly relative to the spindle housing base 3U, 3L. A grinding disc dressing apparatus 4 is mounted on the column 1.

The grinding disc dressing apparatus 4 comprises a rotary dressing roll 5 (hereinafter referred as "dressing roll"), a rotatable main shaft 11 disposed radially outwardly of the two grinding discs 2U and 2L and extending parallel to the axes of these grinding discs, and an arm 13 fixedly secured at one end to the main shaft 11. The distal end of the arm 13 is movable along the opposed sides (active grinding surfaces) of the two grinding discs 2U and 2L. The dressing roll 5 is mounted on the distal end of the arm 13 and is driven for rotation about its axis extending in the direction of movement of the distal end of the arm 13.

Figure 2:
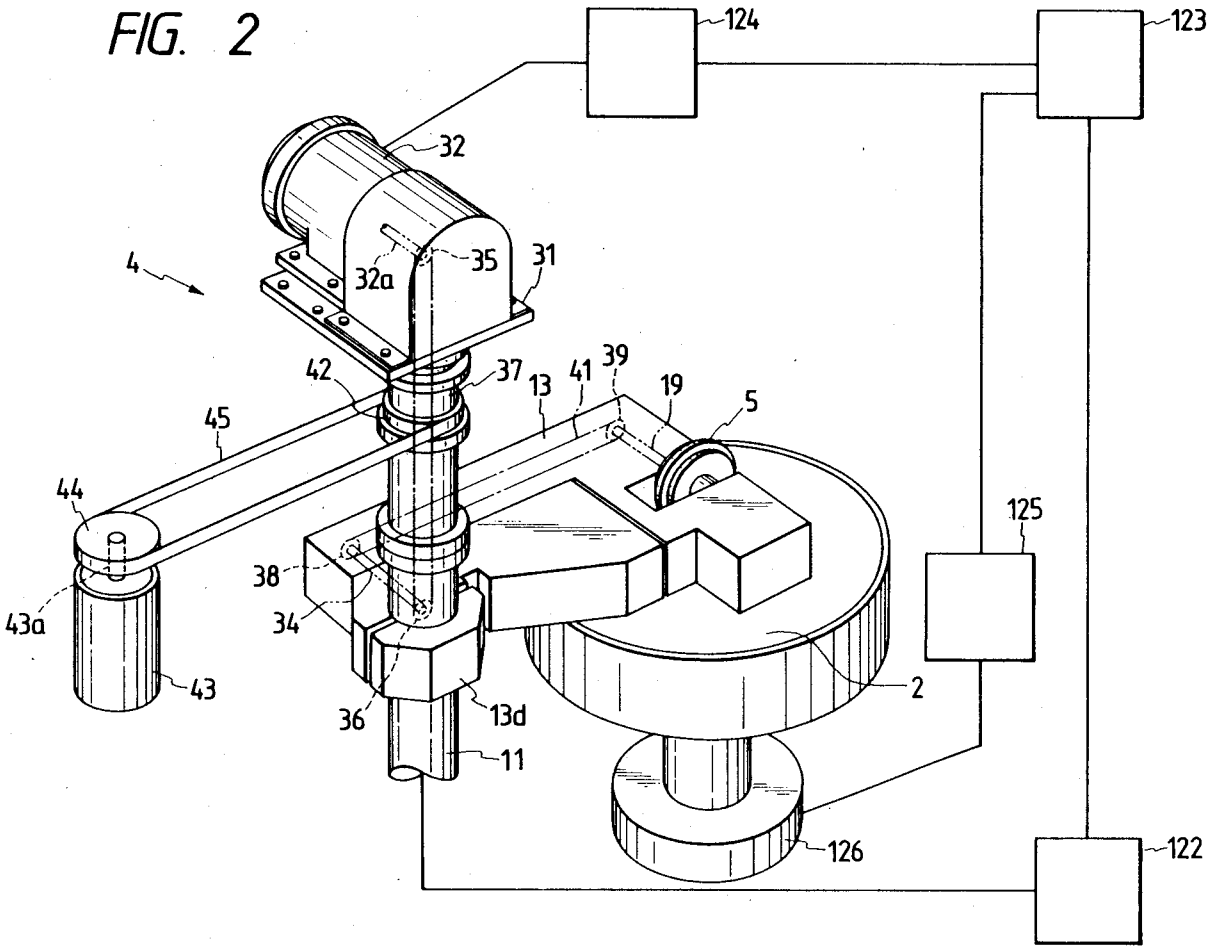
FIG. 2 is a perspective view of a portion of a grinding disc dressing apparatus according to the present invention.

FIG. 2 is a perspective view of a portion of the grinding disc dressing apparatus 4. A motor 32 is fixedly mounted on a motor mounting base 31 fixedly mounted on the upper end of the main shaft 11. The motor 32 has a drive or output shaft **32*a* extending perpendicularly to the main shaft 11. A pulley 35 is fixedly mounted on an outer end of the drive shaft 32*a*, and a pulley 36 is fixedly mounted on one end of an intermediate shaft 34 rotatably borne by bearing means and mounted within the arm 13, the intermediate shaft 34 extending parallel to the drive shaft 32*a* and intersecting the main shaft 11. An endless belt 37 extends around the two pulleys 35 and 36, the endless belt 37 extending into the main shaft 11. A pulley 38 is fixedly mounted on the other end of the intermediate shaft 34, and a pulley 39 is fixedly mounted on a dressing roll shaft 19 on which the dressing roll 5 is fixedly mounted for rotation therewith. An endless belt 41 is mounted within the arm 13, and extends around the two pulleys 38 and 39. With this arrangement, when the variable speed motor 32 is energized, the pulley 35 is rotated, and the rotation of the pulley 35 is transmitted to the intermediate shaft 34 via the belt 37 and the pulley 36. The rotation of the intermediate shaft 34 is transmitted to the dressing roll shaft 19 via the pulley 38, the belt 41 and the pulley 39, so that the dressing roll shaft 19 rotates together with the dressing roll 5** fixedly mounted thereon.

A pulley 44 is fixedly mounted on an outer end of a drive shaft **43*a* of a feed motor 43 arranged in a fixed fashion, and a pulley 42 is fixedly mounted on the main shaft 11. An endless belt 45 extends around the two, pulleys 44 and 45. A detector 122 for detecting the angle of rotation of the main shaft 11 is connected to the main shaft 11. A detection signal outputted from the detector 122 is inputted into an arithmetic unit 123. From the detection signal from the detector 122, the arithmetic unit 123 calculates the position of the operating point (at which the dressing roll 5 acts on the grinding disc to dress it ) relative to the axis of the grinding disc 2, and outputs a signal to a speed control unit 124 so as to vary the speed of rotation of the dressing roll 5 so that the ratio of the peripheral speed of the grinding disc 2 to the peripheral speed of the dressing roll 5 at the operating point can be kept constant. For this purpose, the speed control unit 124 varies the speed of the motor 32. A grinding disc driving motor 126 connected to the spindle of the grinding disc may be a constant speed motor in the case where the grinding disc 2 is to be controlled to rotate at a constant speed. However, the grinding disc driving motor 126 is a variable speed motor in the case where the speed of rotation of the grinding disc 2 is to be varied. The motor 126 is controlled by the signal from the arithmetic unit 123 via a speed control unit 125** for controlling the speed of the grinding disc spindle.

The dressing roll 5 is rotated, and in this condition the feed motor 43 is rotated in its normal and reverse directions in an alternate manner, so that the pulley 44 is rotated to rotate the pulley 42 via the belt 45. As a result, the main shaft 11 rotates to swingingly move the arm 13, so that the dressing roll 5 grinds or dresses the side of the grinding disc 2.

The arithmetic unit 123 can vary the ratio between the peripheral speeds of the dressing roll 5 and grinding disc 2 at the dressing or operating point. However, as described above, in this embodiment, this ratio is kept substantially constant. Even if the dressing is carried out with this ratio kept substantially constant, the speed in the tangential direction of the dressing of the grinding disc varies, and correction can be made if necessary.

Figure 3:
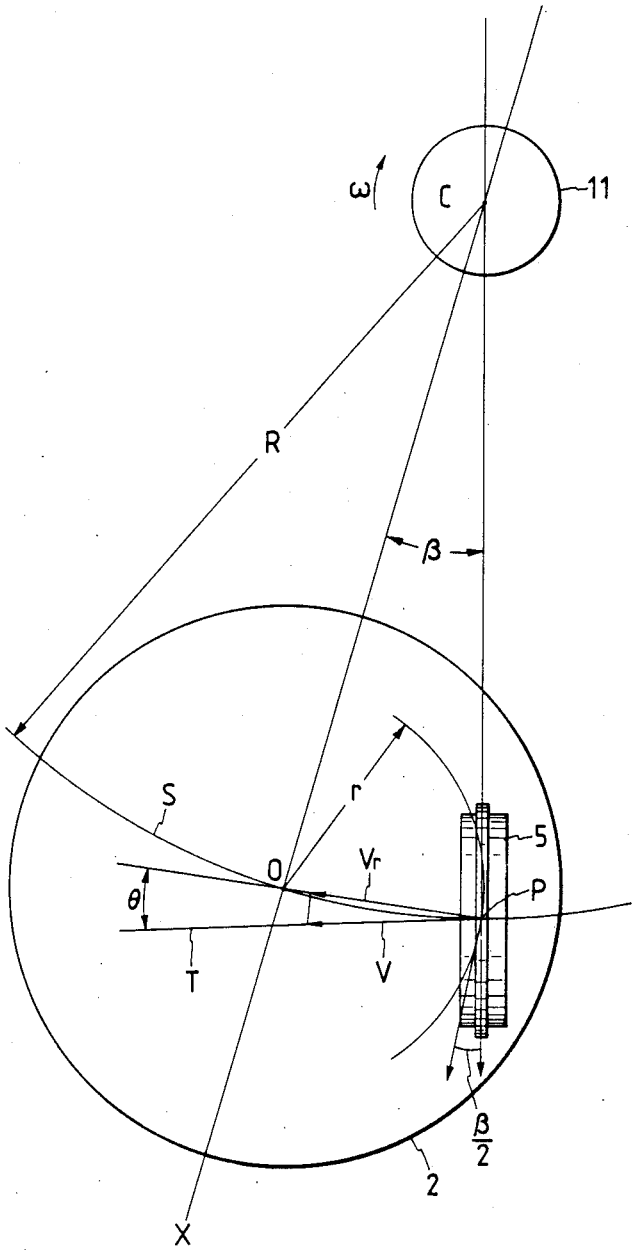
FIG. 3 is a schematic plan view of the grinding disc dressing apparatus.

FIG. 3 is a schematic plan view of the grinding disc dressing apparatus 4. The operating point P at which the dressing roll 5 acts on the grinding disc 2 generates an arc S on a circle having a center disposed at the axis C of the main shaft 11. The arc S passes through the center or axis O of the grinding disc 2. Here, the distance between the centers C and O (that is, the radius R of the arm 13) is represented by R, and a straight line extending through the centers C and O is represented by a base line C-X, and the angle between the base line C-X and the line extending between the center C and the operating point P is represented by $\beta$. If the angular velocity of the main shaft 11 is represented by $\omega$, the speed V at the point P in the direction tangential to the arc S is represented by ($V=\omega R$). If the angle between the tangential line T at the point P and the line extending between the point P and the center O of the grinding disc 2 is represented by $\theta$, the speed Vr at the point P in the radial direction of the grinding disc 2 is represented by ($Vr=\omega R\cdot\cos\theta$). $\theta$ is equal to $\beta/2$ ($\theta=\beta/2$), and therefore there is established the formula ($Vr=\omega R\cdot\cos\beta/2$). Therefore, in order to keep "Vr" constant, the speed of rotation of the main shaft 11 must be controlled in accordance with the formula ($\omega R\cdot\cos\beta/2=\text{constant}$).

In this case, with respect to the above formula ,($\omega R\cdot\cos\beta/2=\text{constant}$), $\cos\beta/2$ is nearly equal to 1 ($\cos\beta/2\approx 1$), and therefore the formula ($\omega R$ constant) is obtained. Therefore, even if the main shaft 11 is set to move at a constant angular velocity $\omega$, there is practically encountered no problem.

Let's assume that the grinding disc 2 is designed to rotate at a constant speed. In this case, in order to keep the ratio between the peripheral speeds of the dressing roll 5 and the grinding disc 2 at the operating point P, the speed of rotation of the dressing roll 5 is made proportional to the distance between the operating point P and the center O of the grinding disc 2 (that is, a radius between the center O and the operating point P). Since the formula ($r=PO=2R\sin\beta/2$) is established, the value of the radius r can be easily obtained through calculation using the value of the angle $\beta$ determined by the detector 122.

The difference in angle between the direction of movement of the outer periphery of the dressing roll 5 at the operating point P and the direction of movement of the grinding disc 2 at the operating point P is $\beta/2$. The components of the peripheral speed of the outer periphery of the dressing roll 5 at the operating point P in the direction of movement can be obtained by multiplying the peripheral speed by $\cos\beta/2$. However, $\cos\beta/2$ is nearly equal to 1 ($\cos\beta/2=1$), and therefore it can be practically considered that the direction of movement of the outer periphery of the dressing roll 5 coincides with the direction of movement of the side of the grinding disc at the operating point P. In this embodiment, although the dressing roll 5 is angularly moved or fed about the main shaft 11 disposed parallel to the axis of the grinding disc, the invention is not to be restricted to this embodiment. For example, the dressing grinding disc head may be guided by a linear guide so that the dressing roll can be fed in the radial direction of the grinding disc.

In this embodiment, although the rotation of the grinding disc is kept at a constant speed with the rotational speed of the dressing roll varied, the rotation of the dressing roll can be kept at a constant speed with the rotational speed of the grinding disc varied. Also, the rotational speeds of the dressing roll and the grinding disc can both be controlled in a variable manner.

As described above, the grinding disc dressing apparatus of the present invention for dressing the active grinding surface of the grinding disc of a surface grinding machine comprises the feed means for moving the dressing roll between an outer periphery of the grinding disc and the central portion of the grinding disc generally radially of the grinding disc so as to dress the active grinding surface of the grinding disc. The first drive means rotates the dressing roll in such a manner that the speed of rotation of the dressing roll can be varied. The second drive means rotates the grinding disc in such a manner that the speed of rotation of the grinding disc can be varied. The control means controls the operation of at least one of the two drive means so as to arbitrarily vary the ratio between the peripheral speeds of the dressing roll and the grinding disc at the operating point where the dressing roll acts on the active grinding surface of the grinding disc during the dressing operation.

With this construction, the ratio between the peripheral speeds of the dressing roll and the grinding disc can be arbitrarily controlled, and therefore advantageously, the rotary dressing roll can accurately dress the side (active grinding surface) of the grinding disc of a surface grinding machine.

A modified form of the invention will now be described with reference to FIGS. 4 to 7. In this embodiment, each of upper and lower grinding discs 2U and 2L (see FIG. 1) is in the form of a super grain grinding disc, and a grinding disc dressing apparatus 4 (see FIG. 4) comprises a rotary dressing roll or grinding stone 5 (hereinafter referred to as "dressing roll"), a rotatable main shaft 11 disposed radially outwardly of the two grinding discs 2U and 2L and extending parallel to the axes of these grinding discs, and an arm 13 fixedly secured at one end to the main shaft 11. The distal end of the arm 13 is movable along the opposed sides (active grinding surfaces) of the two grinding discs 2U and 2L. The dressing roll 5 is mounted on the distal end of the arm 13, and is driven for rotation about its axis extending in the direction of movement of the distal end of the arm 13. The arm 13, drive means for driving the dressing roll 5, and a drive device for swingingly moving the arm 13 will now be described in detail.

Figure 4:
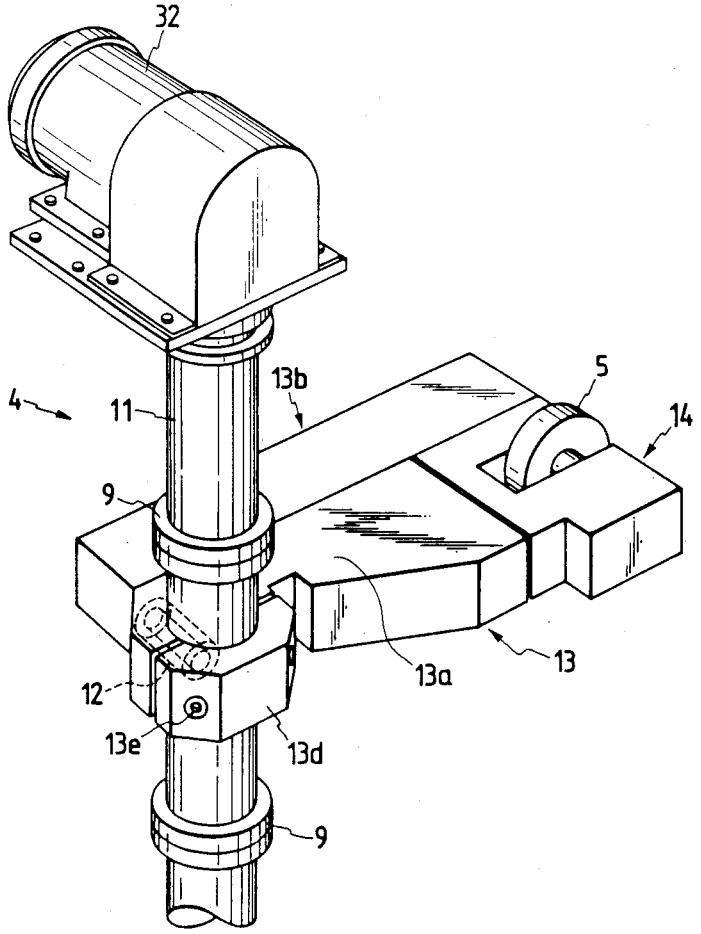
FIG. 4 is a perspective view of a portion of a modified grinding disc dressing apparatus.

FIG. 4 is a perspective view of a portion of the grinding disc dressing apparatus 4. The upstanding main shaft 11 of a hollow construction is rotatably mounted on brackets 28 (FIG. 6) through bearings 9 in such a manner that the main shaft 11 is not allowed to move along its axis, the brackets being fixedly mounted on the column 1. A short tube 12 is fixedly secured to the main shaft 11 in perpendicular relation thereto. The short tube 12 is disposed parallel to the axis of rotation of the dressing roll 5, and communicates with the main shaft 11. The arm 13 is fixedly connected to the short tube 12, communicates with the short tube 12, and is disposed in perpendicular relation to the short tube 12. The arm 13 extends perpendicularly to the axes of the upper and lower grinding discs 2U and 2L. A dressing roll head 14 is fixedly secured to the distal end of the arm 13, the dressing roll head 14 rotatably supporting a dressing roll shaft 19 (see FIG. 5) on which the dressing roll 5 is fixedly mounted.

Figure 5:
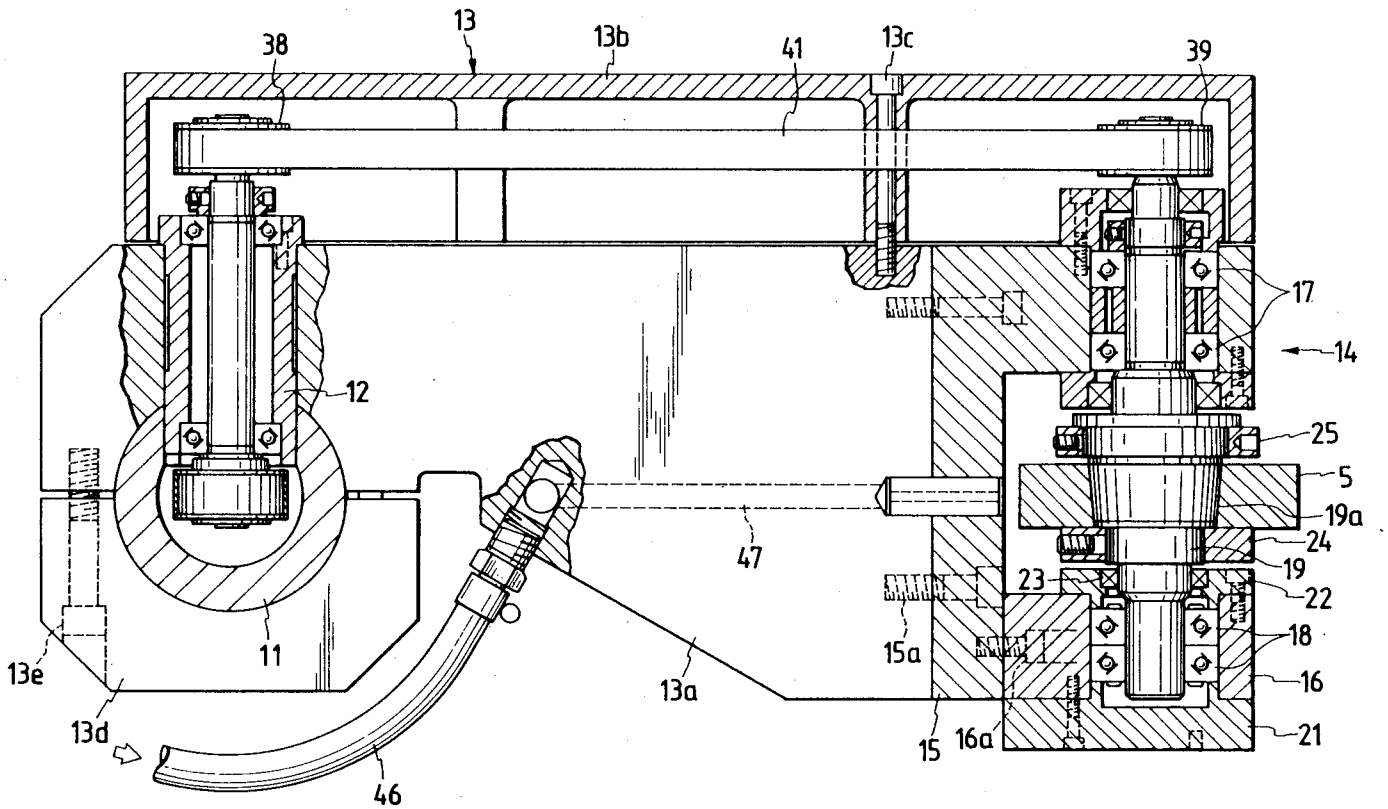
FIG. 5 is a horizontal cross-sectional view of the grinding disc dressing apparatus of FIG. 4.

FIG. 5 is a horizontal cross-sectional view of the grinding disc dressing apparatus taken along a plane passing through the dressing roll shaft 19. The dressing roll head 14 comprises a first bearing box 15 sealingly holding bearings 17, a second bearing box 16 fixedly secured to the first bearing box 15 by a bolt 16*a* and sealingly holding bearings 18, and the dressing roll shaft 19 borne by the bearings 17 and 18 and having the dressing roll 5 fixedly mounted thereon. The dressing roll shaft 19 is supported by the bearings 17 in such a manner that the dressing roll shaft 19 is not allowed to move along its axis. Lids 21 and 22 are fitted in and fixed to the second bearing box 16, and the bearings 18 fitted in the second bearing box 16 are held by the lids 21 and 22 against movement along their axes. A seal ring 23 is provided at that portion of the lid 22 through which the dressing roll shaft 19 passes, thereby forming a seal between the lid 22 and the dressing roll shaft 19. The dressing roll 5 has a mounting central hole of a tapered configuration, and a tapered portion 19*a* of the dressing roll shaft 19 is fitted in the tapered mounting hole of the dressing roll 5. The dressing roll 5 is fixed to the dressing roll shaft 19 by a nut 24 threaded on the dressing roll shaft 19. A nut 25 is threaded on the dressing roll shaft 19 adjacent to the greater diameter end of the tapered portion 19*a*. The nut 25 is used to remove the dressing roll 5 from the dressing roll shaft 19 as hereinafter be more fully described.

For replacing the dressing roll 5 by a new one, the bolt 16*a* is removed, and the second bearing box 16 is removed from the first bearing box 15 as a unit, so that the bearing 18 can be disengaged from the dressing roll shaft 19. The nut 24 is loosened and removed from the dressing roll shaft 19, and then the nut 25 is rotated to move along the dressing roll shaft 19, disengaged from the tapered portion 19*a* of the dressing roll shaft 19, thus enabling the removal of the dressing roll 5 from the dressing roll shaft 19. Then, the nut 25 is returned to its original position, and the new dressing roll 5 is fitted on the tapered portion 19*a* of the dressing roll shaft 19. Then, the nut 24 is threaded onto the dressing roll shaft 19, so that the dressing roll 5 is fixed to the dressing roll shaft 19. Then, the second bearing box 16 in the form of a unit is attached to the dressing roll shaft 19 in such a manner that the bearings 18 are fitted on the dressing roll shaft 19. Then, the second bearing box 16 is fixed to the first bearing box 15 by the bolt 16*a*.

Figure 6:
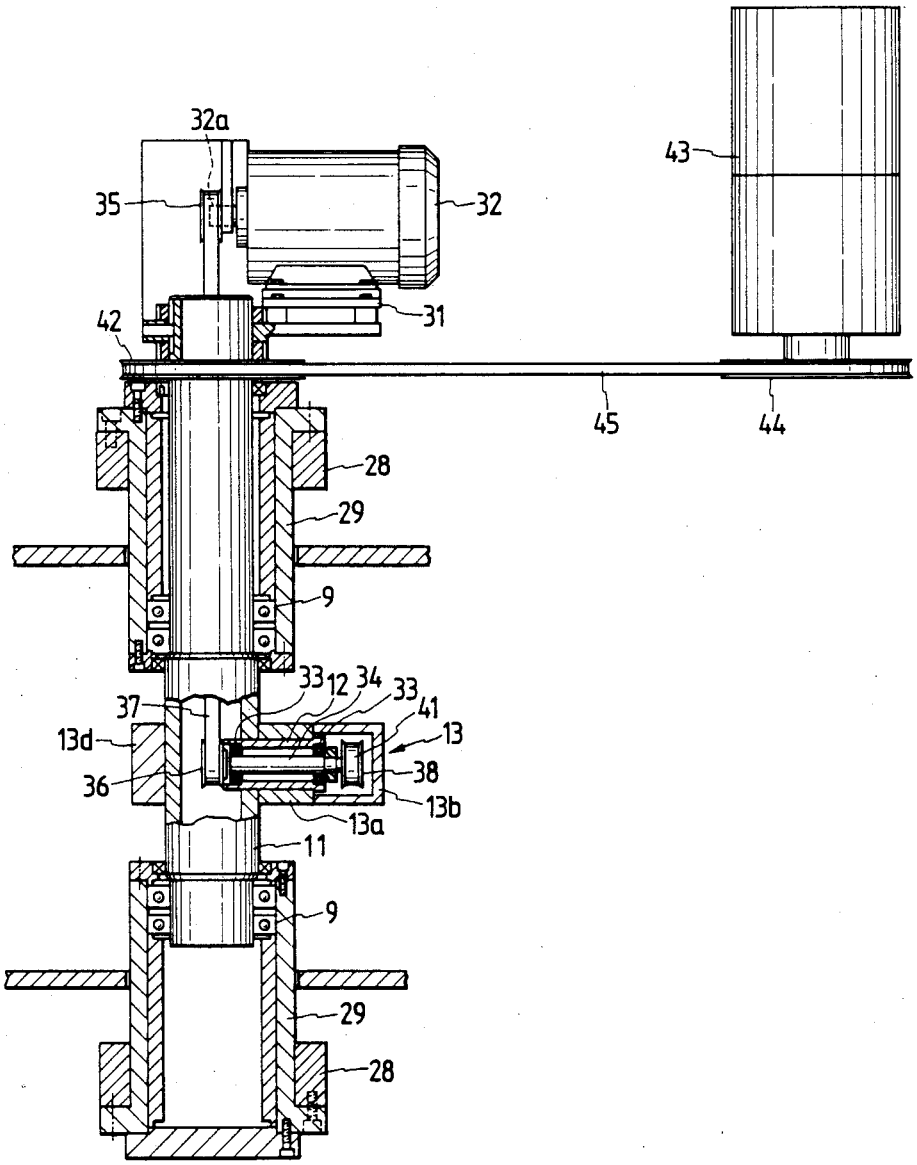
FIG. 6 is a vertical cross-sectional view of the grinding disc dressing apparatus of FIG. 4.

FIG. 6 is a vertical cross-sectional view of the grinding disc dressing apparatus taken along a plane passing through the main shaft 11 and the short tube 12. The main shaft 11 is hollow and is supported by the bearings 9 at its upper and lower portions. The upper and lower bearings 9 are sealingly mounted respectively within the bearing boxes 29 fixedly fitted respectively in the brackets 28 fixedly mounted on the column 1. As described above, the hollow short tube 12 is fixedly connected to the main shaft 11 in perpendicular relation thereto, and communicates therewith (see FIGS. 5 and 6). The arm 13 having a hollow portion is fixedly connected to the short tube 12. As described above, the dressing roll head 14 is fixedly mounted on the distal end of the arm 13.

The arm 13 comprises a reinforcement rigid portion 13*a* in which the short tube 12 is received, and a lid 13*b* sealingly secured to one side of the reinforcement rigid portion 13*a* by bolts 13*c* in such a manner as to provide the hollow portion. The lid 13*b* is sealingly connected to the input end of the first bearing box 15. The reinforcement rigid portion 13*a* and a cap 13*d* hold the main shaft 11 therebetween, and are urged toward each other by bolts 13*e* to be fixed to the main shaft 11. Therefore, the main shaft 11, the short tube 12 and the reinforcement rigid portion 13*a* of the arm 13 are integrally connected together.

The bearing box 15 is fixedly secured to the distal end of the reinforcement rigid portion 13*a* by bolts 15*a*.

In the construction of this embodiment, the main shaft 11, the short tube 12 and the arm 13 communicate with one another in a hollow condition, and a power transmitting device for transmitting power to the dressing roll head 14 from the exterior is mounted within such a hollow construction. A motor 32 is fixedly mounted on a motor mounting base 31 fixedly mounted on the upper end of the main shaft 11. A drive shaft 32*a* of the motor 32 extends perpendicularly to the main shaft 11. An intermediate shaft 34 is rotatably received in the short tube 12 through bearings 33. A first endless transmitting device comprises a pulley 35 fixedly mounted on the end of the drive shaft 32*a*, a pulley 36 fixedly mounted on one end of the intermediate shaft 34, and an endless belt 37 extending around the two pulleys 35 and 36. The belt 37 is mostly received in the main shaft 22. A second endless transmitting device comprises a pulley 38 fixedly mounted on the other end of the intermediate shaft 34, a pulley 39 fixedly mounted on one end of the dressing roll shaft 19, and an endless belt 41 extending around the two pulleys 38 and 39. The belt 41 is received in the hollow portion of the arm 13.

As shown in FIG. 6, a pulley 42 is fixedly mounted on the main shaft 11, and a pulley 44 is fixedly mounted on one end of a drive shaft of a feed motor 43. An endless belt 45 extends around the two pulleys 42 and 44.

As shown in FIG. 5, a pipe 46 for supplying a liquid used for the dressing of the grinding disc is connected to a passage 47 provided in the reinforcement rigid portion 13*a* of the arm 13. The liquid is supplied from a liquid source disposed externally of the apparatus. The passage 37 has an outlet opening disposed in opposed relation to the outer periphery of the dressing roll 5.

Figure 7:
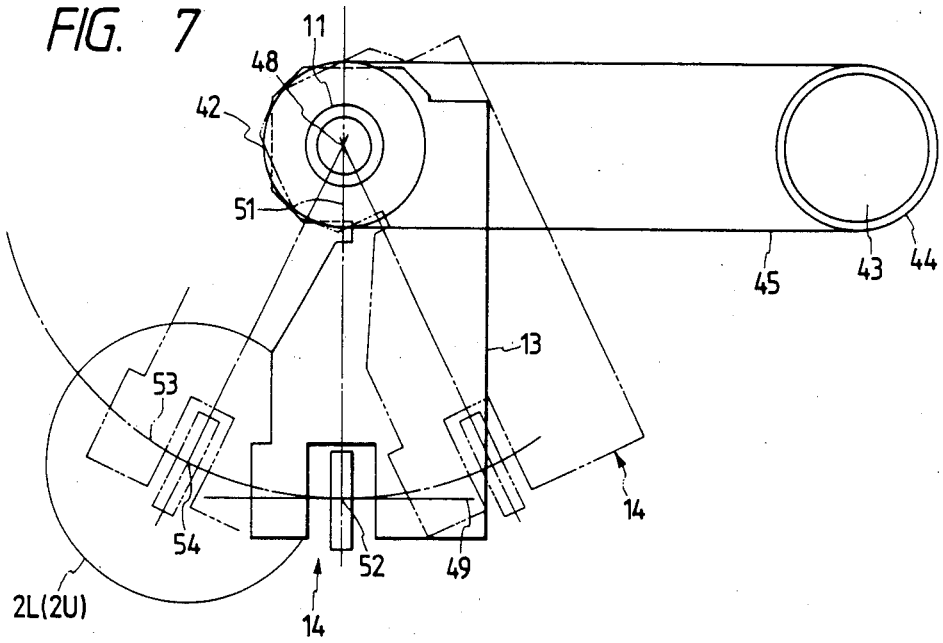
FIG. 7 is a plan view of the grinding disc dressing apparatus of FIG. 4.

FIG. 7 is a plan view showing the position of the grinding disc dressing apparatus relative to the upper and lower grinding disc 2U and 2L. A straight line 51 extends from the center or axis 48 of the main shaft 11, and perpendicularly intersects the axis 49 of the dressing roll shaft 19 at a point 52. When the main shaft 11 rotates, the point 52 moves along an orbit or circular path 53 which passes through the centers or axes 54 of the two grinding discs 2U and 2L. Therefore, when the feed motor 43 is rotated in normal and reverse directions, the main shaft 11 is rotated through the pulley 44, the belt 45 and the pulley 42. As a result, the arm 13 is swingingly or angularly moved, so that the dressing roll head 14 reciprocally moves between a position indicated by a phantom line (disposed outwardly of the grinding discs 2U and 2L) and a position disposed at the central portions of the grinding discs 2U and 2L. During this swinging movement of the arm 13, the grinding disc 2U and 2L to be dressed is kept rotated, and the motor 32 is energized so that the rotation of the motor 32 is transmitted to the intermediate shaft 34 through the pulley 35, the belt 37 and the pulley 36. Thus, the intermediate shaft 34 is rotated together with the pulley 38 fixedly mounted thereon. The rotation of the pulley 38 is transmitted to the pulley 39 via the belt 41, so that the dressing roll shaft 19 having the pulley 39 fixedly mounted thereon is rotated together with the dressing roll 5.

The depth of cut into the grinding disc 2U, (2L) by the dressing roll 5 is determined by the amount of feed of the grinding disc 2U, (2L) along the axis thereof. During the grinding disc dressing operation, the liquid suited for the dressing or tooling is fed through the pipe 46 and the passage 47. In this manner, the active grinding surface of the grinding disc 2U, 2L is dressed.

Figure 8:
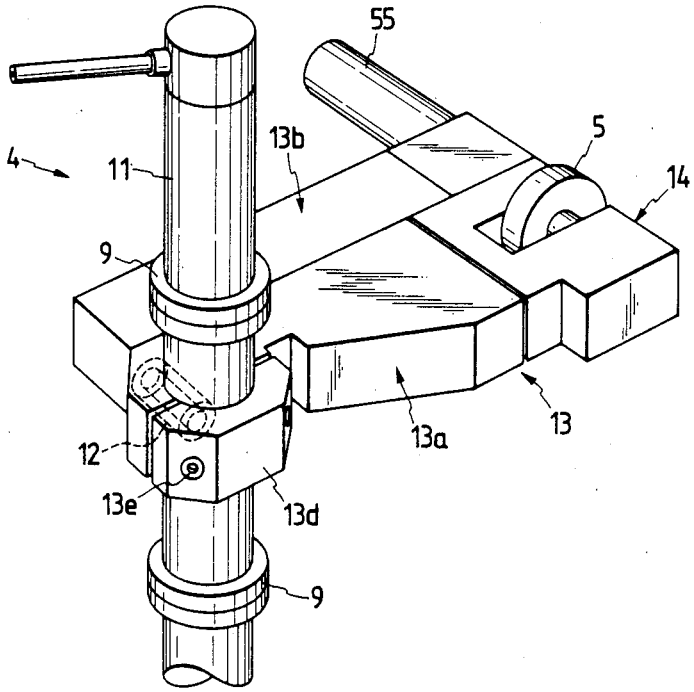
FIG. 8 is a perspective view of a portion of another modified grinding disc dressing apparatus.

FIG. 8 shows another modified form of the invention in which a drive device for driving the dressing roll shaft 19 is mounted on the distal end of the arm 13. More specifically, a motor 55 for driving the dressing roll 5 of the dressing roll head 14 is fixedly mounted on the dressing roll head 14. The motor 55 is in the form of an electric motor or a fluid-operated motor using pressurized liquid or air.

Figure 9:
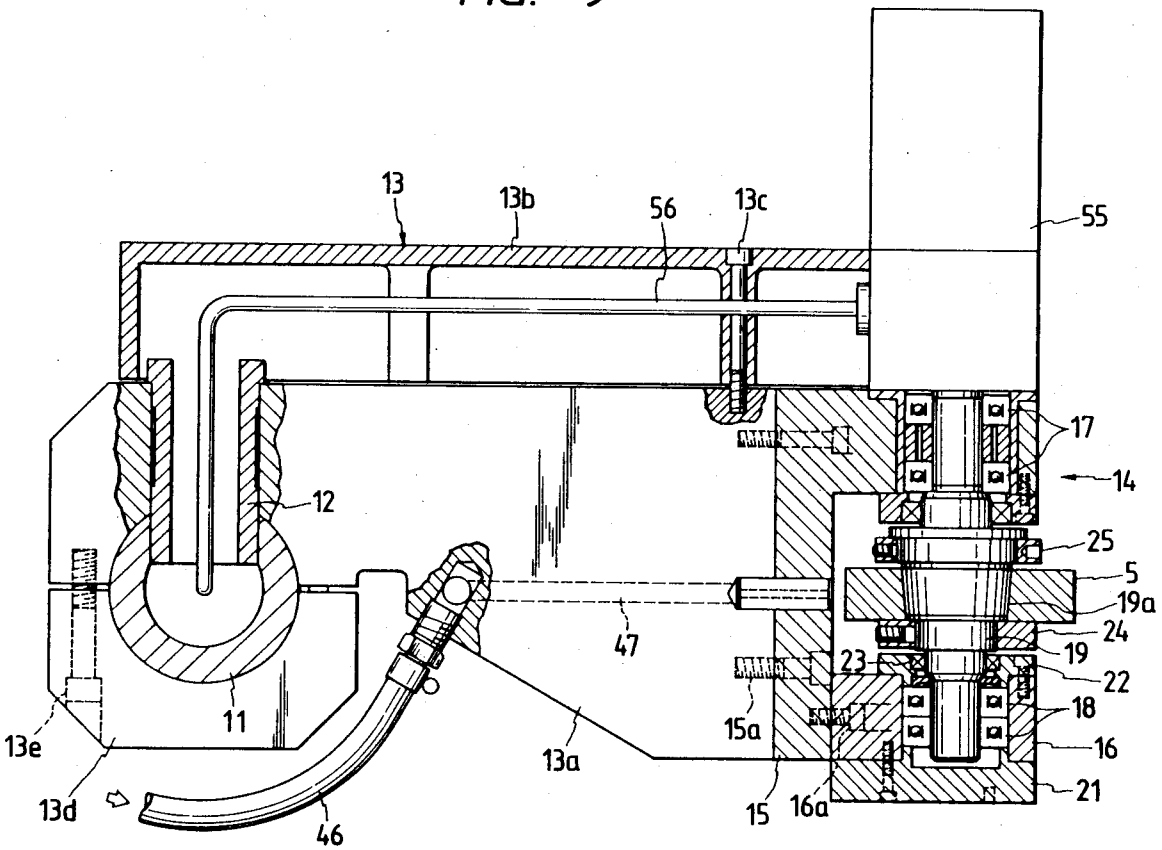
FIG. 9 is a horizontal cross-sectional view of the dressing apparatus of FIG. 8.

FIG. 9 shows the horizontal cross-section of the dressing roll head 14 of FIG. 8. The dressing roll shaft 19 is connected to the drive shaft of the motor 55. The construction of the dressing roll head 14 of this embodiment is the same as that described in the preceding embodiment. However, the motor 32, the first and second endless transmitting device, the intermediate shaft 34 and the bearings 33 of the preceding embodiment are not provided in this embodiment. The feed motor 43 for swingingly moving the arm 13, the pulley 44 and the pulley 42 described in the preceding embodiment are also provided in this embodiment.

Figure 10:
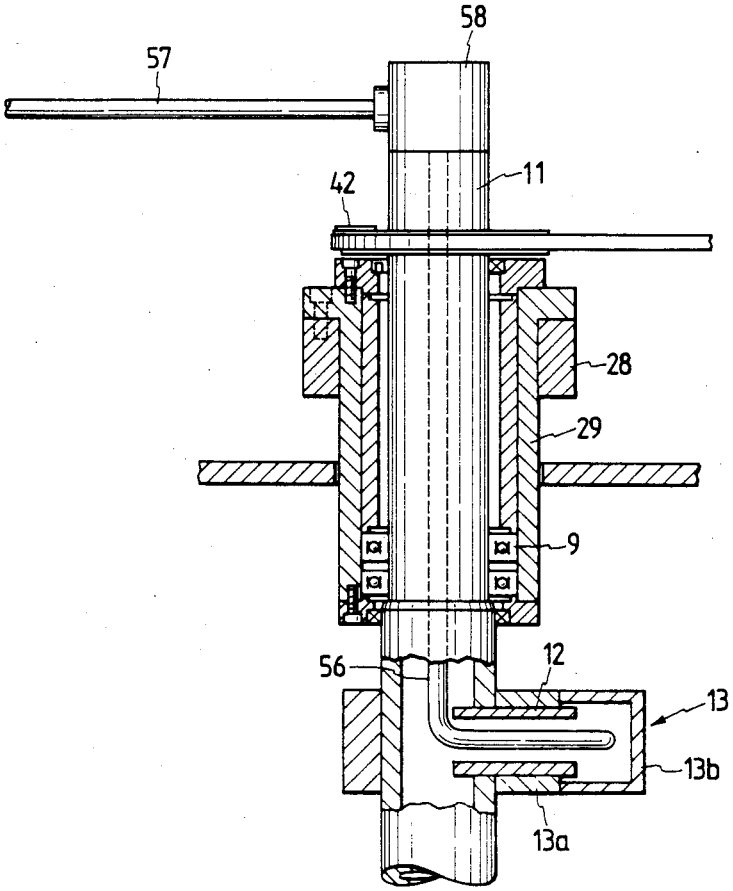
FIG. 10 is a vertical cross-sectional view of the dressing apparatus of FIG. 8, showing a main shaft.

As described above in the preceding embodiment, in this embodiment, also, the main shaft 11 supporting the arm 13 is of a hollow construction, and the short tube 12 is fixedly connected to the main shaft 11 in perpendicular relation thereto, and communicates with the main shaft 11, and is disposed parallel to the dressing roll shaft 19. Also, the arm 13 disposed perpendicularly to the axes of the grinding discs 2U and 2L is fixedly connected to the main shaft 11. In the case where the motor 55 comprises an electric motor, a line 56 comprising an electric wire is passed through the arm 13. In the case where the motor 55 comprises a fluid-operated motor, such line 56 comprises a pipe for feeding a pressurized fluid. In the latter case, as shown in fIG. 10, the fluid supply pipe 56 is fixed to the end portion of the main shaft, and is connected to an external pipe 57 through a fluid-pressure rotary fitting 58 mounted on the main shaft 11.

The construction of this embodiment may be suitably modified so long as the wire 56 or the pipe 56 can be protected against an external force, and is not limited to the illustrated embodiment.

Figure 11:
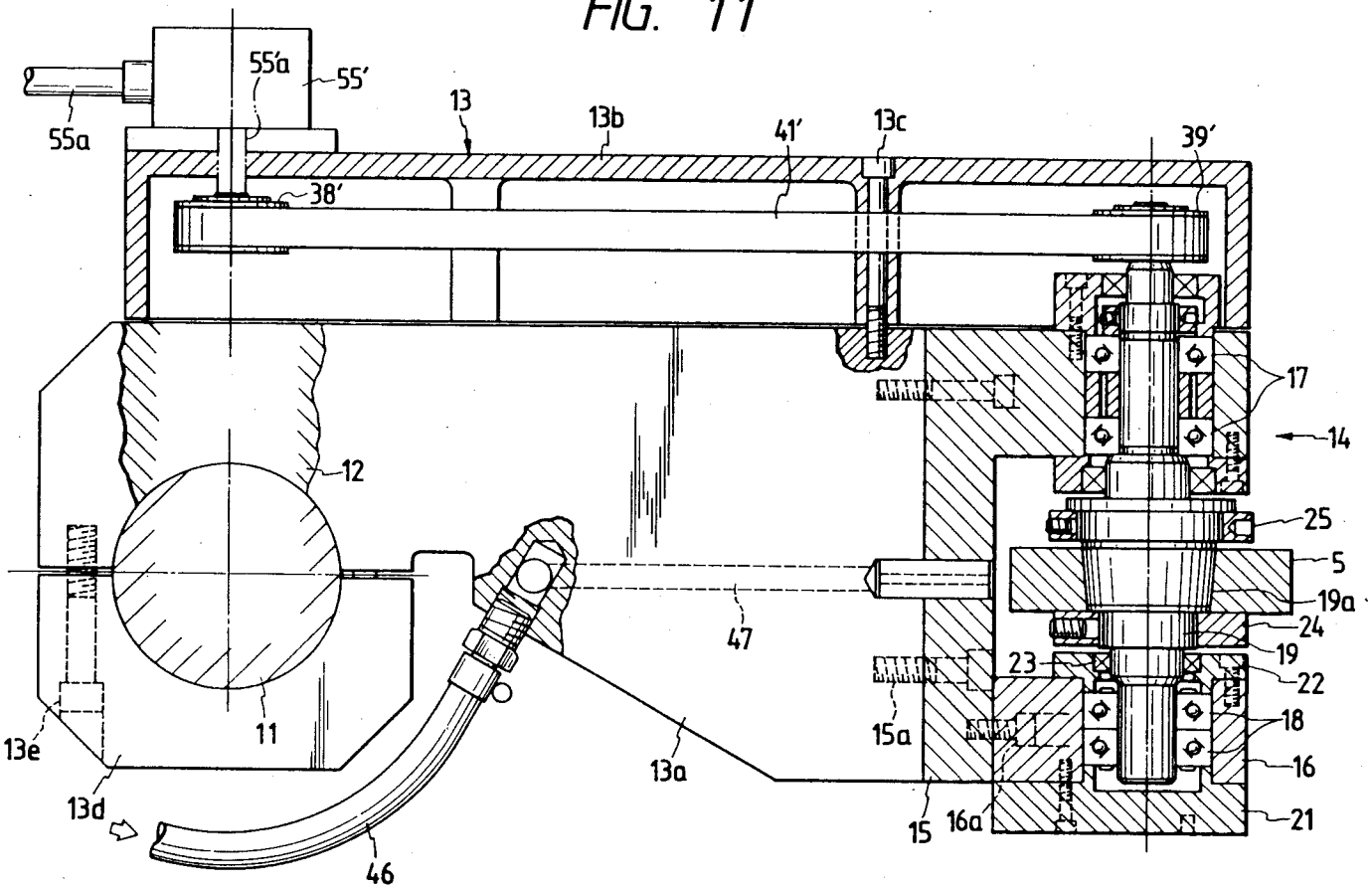
FIG. 11 is a horizontal cross-sectional view of a further modified grinding disc dressing apparatus.

FIG. 11 shows a further preferred embodiment of the invention employing a modified drive device for driving the dressing roll shaft 19. In this embodiment, a motor 55′ for driving the dressing roll shaft 19 is fixedly mounted on the proximal end of the arm 13. A pulley 38′ is fixedly mounted on the drive or output shaft 55′a of the motor 55′ extending into the arm 13. A pulley 39′ is fixedly mounted on the dressing roll shaft 19, and an endless belt 41′ extends around the two pulleys 38′ and 39′. The motor 55′ comprises an electric motor or a fluid-operated motor using pressurized liquid or air. A power transmitting medium 55*a* connecting a power source to the motor 55′ can be flexible and be mounted externally of the apparatus, as shown in FIG. 11. Alternatively, the power transmitting medium 55*a* may be so arranged as to pass through the main shaft 11 and the short tube 12. In the case where the motor 55′ is an electric motor, the power transmitting medium 55*a* comprises an electric wire. In the case where the motor 55′ is a fluid-operated motor, the power transmitting medium 55*a* comprises a pipe for feeding a pressurized fluid.

The pipe 56 is connected to the power source in the same manner described above with reference to FIG. 10; however, the construction of this embodiment may also be suitably modified so long as the wire 56 or the pipe 56 can be protected against an external force, and is not limited to the illustrated embodiment. Further, the method of and the device for mounting the motor 55′ may be suitably modified so long as the intended functions can be achieved, and are not limited to the illustrated embodiment.

The grinding disc dressing apparatus of the present invention for dressing the grinding disc of a surface grinding machine comprises the main shaft extending parallel to the axis of rotation of the grinding disc. Means is provided for angularly moving the main shaft about the axis thereof. The arm is fixedly mounted on the main shaft at the proximal end of the arm disposed radially outwardly of the outer periphery of the grinding disc, so that the arm is angularly movable together with the main shaft. The arm has the distal end movable along the active grinding surface of the grinding disc. The rotary dressing roll is mounted on the distal end of the arm. The dressing roll has the axis of rotation disposed in the direction of movement of the distal end of the arm. The dressing roll acts on the active grinding surface to dress. Means is provided for rotating the dressing roll. With this construction, the active grinding surface of the grinding disc of a surface grinding machine which can not be dressed without the use of the rotary dressing roll can be efficiently dressed. Such grinding disc contains super abrasive grains or the like.

The grinding disc dressing apparatus of the present invention for dressing the grinding disc of a surface grinding machine comprises the main shaft extending parallel to the axis of rotation of the grinding disc. Means is provided for angularly moving the main shaft about the axis thereof. The arm is fixedly mounted on the main shaft at the proximal end of the arm disposed radially outwardly of the outer periphery of the grinding disc, so that the arm is angularly movable together with the main shaft. The arm has the distal end movable along the active grinding surface of the grinding disc. The rotary dressing roll is mounted on the distal end of the arm. The dressing roll has the axis of rotation disposed in the direction of movement of the distal end of the arm. The dressing roll acts on the active grinding surface to dress. The motor is mounted on the distal end of the arm. The motor is drivingly connected to the dressing roll shaft for rotating the same. The dressing roll is fixedly mounted on the dressing roll shaft for rotation therewith. The power transmitting medium is connected to the motor so as to supply power to the motor from the power source. With this arrangement, the grinding disc dressing apparatus is simple in construction.

What is claimed is:

1. A grinding disc dressing apparatus for dressing an active grinding surface of a grinding disc of a surface grinding machine, said apparatus comprising:

(a) a rotary dressing roll having an axis of rotation perpendicular to an axis of rotation of said grinding disc;

(b) feed means for moving said dressing roll between an outer periphery of said grinding disc and a central portion of said grinding disc generally radially of said grinding disc so as to dress said active grinding surface;

(c) first drive means for rotating said dressing roll about its axis of rotation;

(d) second drive means for rotating said grinding disc; and (e) control means for controlling the operation of at least one of two drive means so as to arbitrarily vary the ratio between peripheral speeds of said dressing roll and said grinding disc at an operating point where said dressing roll acts on said active grinding surface during the dressing operation.

2. Apparatus according to claim 1, in which one of said first drive means and said second rive means a variable-speed motor, the other comprises a constant-speed motor.

3. Apparatus according to claim 1, in which said first drive means and second drive means comprise variable-speed driving motors.

4. A grinding disc dressing apparatus for dressing a grinding disc of a surface grinding machine, comprising:

(a) a main shaft extending parallel to the axis of rotation of said grinding disc;

(b) means for angularly moving said main shaft about an axis thereof;

(c) an arm fixedly mounted on said main shaft at a proximal end thereof, said arm being disposed radially outwardly of an outer periphery of said grinding disc, so that said arm is angularly movable together with said main shaft, said arm having a distal end movable along an active grinding surface of said grinding disc;

(d) a rotary dressing roll mounted on the distal end of said arm, said dressing roll having an axis or rotation disposed in the direction of movement of said distal end of said arm, said dressing roll acting on said active grinding surface to dress the same; and (e) means for rotating said dressing roll about its axis of rotation to dress said grinding disc.

5. Apparatus according to claim 4, in which said main shaft is of a tubular construction, said arm extending perpendicularly to the axis of said grinding disc, said arm including a short tube which extends perpendicularly to said main shaft in parallel relation to the axis of rotation of said dressing roll, said short tube communicating with said main shaft, said arm having a hollow portion communicating with said short tube, said arm being fixedly connected to said short tube and disposed perpendicularly to said short tube.

6. Apparatus according to claim 5, in which there is provided a dressing roll head mounted on the distal end of said arm, said dressing roll head rotatably supporting a dressing roll shaft on which said dressing roll is fixedly mounted for & rotation together with said dressing roll shaft.

7. Apparatus according to claim 6, further comprising power transmission means including a first endless transmitting device mounted in said main shaft and operatively connecting said power source to an intermediate shaft rotatably received & in said short tube, and a second transmitting device mounted in said arm and operatively connecting said intermediate shaft to said dressing roll shaft.

8. Apparatus according to claim 4, in which said rotating means includes a motor mounted on the distal end of said arm, said motor being drivingly connected to a dressing roll shaft for rotating the same, said dressing roll being fixedly mounted on said dressing roll shaft for rotation therewith, a power transmitting medium being connected to said motor so as to supply power to said motor from a power source.

9. Apparatus according to claim 8, in which said motor comprises an electric motor, said power source being electric energy, and said power transmitting medium being an electric wire.

10. Apparatus according to claim 8, in which said motor comprises a fluid-operated motor, said power source being a pressurized fluid, and said power transmitting medium being a pipe.

11. Apparatus according to claim 4, in which said rotating means includes a motor mounted on said arm, said motor being drivingly connected through an endless transmitting device to a dressing roll shaft for rotating the same, said dressing roll being fixedly mounted on said dressing roll shaft for rotation therewith, a power transmitting medium being connected to said motor so as to supply power to said motor from a power source.

12. Apparatus according to claim 11, in which said motor comprises an electric motor, said power source being electric energy, and said power transmitting medium being an electric wire.

13. Apparatus according to claim 11, in which said motor comprises a fluid-operated motor, said power source being a pressurized fluid, and said power transmitting medium being a pipe.

14. A grinding disc dressing apparatus for dressing a grinding disc of a surface grinding machine, comprising:

(a) a tubular main shaft extending parallel to the axis of rotation of said grinding disc;

(b) means for angularly moving said main shaft about an axis thereof;

(c) an arm, extending perpendicularly to an axis of rotation of said grinding disc, and fixedly mounted on said main shaft at a proximal end thereof, said arm being disposed radially outwardly of an outer periphery of said grinding disc, so that said arm is angularly movable together with said main shaft, said arm having a distal end movable along an active grinding surface of said grinding disc;

(d) a rotary dressing roll mounted on the distal end of said arm, said dressing roll having an axis of rotation disposed in the direction of movement of said distal end of said arm, said dressing roll acting on said active grinding surface to dress the same;

(e) a dressing roll shaft on which said dressing roll is fixedly mounted;

(f) a short tube, fixedly connected to said arm and extending perpendicularly to said main shaft in parallel relation to the axis of rotation of said dressing roll, said arm having a hollow portion communicating with said short tube, said arm being disposed perpendicularly to said short tube, said short tube communicating with said main shaft;

(g) an intermediate shaft rotatably received in said short tube;

(h) means for rotating said dressing roll;

(i) a dressing roll head mounted on the distal end of said arm, mounted for rotation together with said dressing roll shaft;

(j) a power source; and (k) a power transmission means for transmitting power to said dressing roll shaft, said power transmission means including a first endless transmitting device mounted in said main shaft and operatively connecting said power source to said intermediate shaft, and a second transmitting device mounted in said arm and operatively connecting said intermediate shaft to said dressing roll shaft.

15. A grinding disc dressing apparatus for dressing a grinding disc of a surface grinding machine, comprising:

(a) a main shaft extending parallel to the axis of rotation of said grinding disc;

(b) means for angularly moving said main shaft about an axis thereof;

(c) an arm fixedly mounted on said main shaft at a proximal end thereof, said arm being disposed radially outwardly of an outer periphery of said grinding disc, so that said arm is angularly movable together with said main shaft, said arm having a distal end movable along an active grinding surface of said grinding disc;

(d) a rotary dressing roll mounted on the distal end of said arm, said dressing roll having an axis or rotation disposed in the direction of movement of said distal end of said arm, said dressing roll acting on said active grinding surface to dress the same;

(e) a dressing roll shaft on which said rotary dressing roll is fixedly mounted;

(f) means for rotating said dressing roll, including a motor mounted on the distal end of said arm, said motor being drivingly connected to said dressing roll shaft for rotating the same; and (g) a power transmitting medium, connected to said motor, for supplying power to said motor from a power source.

16. A grinding disc dressing apparatus for dressing a grinding disc of a surface grinding machine, comprising:

(a) a main shaft extending parallel to the axis of rotation of said grinding disc;

(b) means for angularly moving said main shaft about an axis thereof;

(c) an arm fixedly mounted on said main shaft at a proximal end thereof, said arm being disposed radially outwardly of an outer periphery of said grinding disc, so that said arm is angularly movable together with said main shaft, said arm having a distal end movable along an active grinding surface of said grinding disc;

(d) a rotary dressing roll mounted on the distal end of said arm, said dressing roll having an axis of rotation disposed in the direction of movement of said distal end of said arm, said dressing roll acting on said active grinding surface to dress the same;

(e) a dressing roll shaft on which said dressing roll is fixedly mounted;

(f) means for rotating said dressing roll, including a motor mounted on said arm;

(g) an endless transmitting device drivingly connected to said motor and to said dressing roll shaft for rotating said dressing roll shaft; and (h) a power transmitting medium, connected to said motor, for supplying power to said motor from a power source.

* * * * *